US005746783A

United States Patent [19]

Compere et al.

[11] Patent Number: 5,746,783

[45] Date of Patent: May 5, 1998

[54] LOW EMISSIONS DIESEL FUEL

[75] Inventors: Alicia L. Compere, Knoxville; William L. Griffith, Oak Ridge; George F. Dorsey, Farragut; Brian H. West, Kingston, all of Tenn.

[73] Assignee: Martin Marietta Energy Systems, Inc., Oak Ridge, Tenn.

[21] Appl. No.: 555,348

[22] Filed: Nov. 8, 1995

Related U.S. Application Data

[63] Continuation of Ser. No. 220,144, Mar. 30, 1994, abandoned.

[51] Int. Cl.[6] ..... C01L 1/32

[52] U.S. Cl. ..... 44/301; 44/302; 44/336; 44/417

[58] Field of Search ..... 44/301, 302, 336, 44/417

[56] References Cited

U.S. PATENT DOCUMENTS

| | | | |
|---|---|---|---|
| 2,657,984 | 11/1953 | Braithwaite et al. | 44/417 |
| 2,714,057 | 7/1955 | Chenicek | 44/336 |
| 3,139,330 | 6/1964 | Malec | 44/336 |
| 3,314,884 | 4/1967 | Cover . | |
| 3,346,494 | 10/1967 | Robbins et al. | 44/301 |
| 3,756,764 | 9/1973 | Ford | 44/301 |
| 3,756,794 | 9/1973 | Ford | 44/301 |
| 3,876,391 | 4/1975 | McCoy et al. | 44/301 |
| 3,900,544 | 8/1975 | Johnson et al. . | |
| 3,915,970 | 10/1975 | Limaye et al. | 44/301 X |
| 4,116,875 | 9/1978 | Nnadi et al. . | |
| 4,384,872 | 5/1983 | Kester et al. . | |
| 4,708,720 | 11/1987 | Grangette et al. | 44/301 |
| 4,731,231 | 3/1988 | Perry . | |
| 4,744,796 | 5/1988 | Hazbun et al. | 44/301 |
| 5,004,479 | 4/1991 | Schon et al. . | |
| 5,081,102 | 1/1992 | Gay et al. . | |
| 5,162,049 | 11/1992 | Bostick | 44/336 |
| 5,177,055 | 1/1993 | Kinsman et al. . | |
| 5,219,955 | 6/1993 | Sung et al. . | |
| 5,292,351 | 3/1994 | DeRosa et al. | 44/417 |
| 5,453,257 | 9/1995 | Diep et al. | 423/235 |

FOREIGN PATENT DOCUMENTS

| | | |
|---|---|---|
| 0 341 274 B1 | 12/1992 | European Pat. Off. . |
| 39 16 643 C1 | 5/1989 | Germany . |

OTHER PUBLICATIONS

A.L. Compere, W.L. Griffith and J.M. Googin; "Stability And Composition Of Palm, Coconut And Soy Oil Fatty Acid Microemulsion Diesel Fuels"; Oak Ridge National Laboratory.

W.L. Griffith, R. Triolo and A.L. Compere; "Analytical Scattering Function Of A Polydisperse Percus–Yevick Fluid With Schulz–(Γ–) Distributed Diameters"; *Physical Review A*; Mar. 1, 1987; vol. 35, No. 5, pp. 2200–2206.

E. Caponetti, A. Lizzio and R. Triolo; "Effect Of Composition On Sizes Of W/O Ethanolamine–Oleic Acid Microemulsions By Small–Angle Neutron Scattering"; *Langmuir*; 1989; vol. 5, No. 2, pp. 359–363.

J.S. Johnson, Jr., W.L. Griffith and A.L. Compere; "Small–Angle Neutron Scattering From Micelles Of Potassium Salts Of 18–Carbon Fatty Acids"; *Langmuir*; 1989; vol. 5, No. 5, pp. 1191–1195.

E. Caponetti, A. Lizzio and R. Triolo; "Alcohol Partition In A Water–In–Oil Microemulsion From Small–Angle Neutron Scattering"; *Langmuir*; 1992; vol. 8, No. 6, pp. 1554–1562.

B.H. West, et al.; "High–Alcohol Microemulsion Fuel Performance In A Diesel Engine"; *The Engineering Society For Advancing Mobility Land Sea Air And Space*; International Fuels and Lubricants Meeting and Exposition; Oct. 22–25, 1990; pp. 1–16.

*Primary Examiner*—Prince Willis, Jr.
*Assistant Examiner*—Cephia D. Toomer
*Attorney, Agent, or Firm*—Morgan & Finnegan; Shelly L. Stafford

[57] ABSTRACT

A method and matter of composition for controlling $NO_x$ emissions from existing diesel engines. The method is achieved by adding a small amount of material to the diesel fuel to decrease the amount of $NO_x$ produced during combustion. Specifically, small amounts, less than about 1%, of urea or a triazine compound (methylol melamines) are added to diesel fuel. Because urea and triazine compounds are generally insoluble in diesel fuel, microemulsion technology is used to suspend or dissolve the urea or triazine compound in the diesel fuel. A typical fuel formulation includes 5% t-butyl alcohol, 4.5% water, 0.5% urea or triazine compound, 9% oleic acid, and 1% ethanolamine. The subject invention provides improved emissions in heavy diesel engines without the need for major modifications.

21 Claims, No Drawings

LOW EMISSIONS DIESEL FUEL

This is a continuation of application Ser. No. 08/220,144, filed on Mar. 30. 1994, now abandoned.

This invention w as made with Government support under contract DE-AC05-84OR21400 awarded by the U.S. Department of Energy to Martin Marietta Energy Systems, Inc., and the Government has certain rights in this invention.

FIELD OF THE INVENTION

The subject invention relates to a method, and a composition therefor, for decreasing $NO_x$ emissions produced from the combustion of fuel. More particularly, the subject invention relates to the addition of an effective amount of urea or a triazine compound (methylol melamines) or a crystalline melamine cyanurate or urea derivatives (such as ethyl, dimethyl, and butyl urea) to a middle distillate base constituent to reduce the $NO_x$ emissions produced during the combustion of the base constituent.

BACKGROUND OF THE INVENTION

The Clean Air Act mandates decreases in $NO_x$ and particulate emissions from diesel engines used in transport and power generation. Combustion emissions. For example, the patents to Hazbun et al. (U.S. Pat. No. 4,744,796) and Schon et al. (U.S. Pat. No. 5,004,479) disclose the use of microemulsion fuel compositions to reduce combustion emissions.

The Clean Air Act Amendments mandate progressive decreases in $NO_x$ and particulate emissions from both stationary and mobile diesel engines. Strategies for reducing emissions from diesel engines include engine redesign, aftertreatments (various combinations of catalysts and emissions control compounds); modifications of fuel production processes, and direct addition of emissions control compounds to fuels. Although all of these technologies could find applications in stationary diesel engines, mobile engines typically used in transport must adjust to rapidly changing load and speed conditions. Additionally, little space is available in mobile for treatment equipment.

The emissions control potential of engine redesign is limited by physical constraints and by combustion chemistry. Similar constraints limit emissions control by catalytic converters.

The most effective systems for controlling $NO_x$ emissions from stationary diesel engines typically involve direct reduction of $NO_x$ by catalytically activated nitrogen compounds. Ammonia, urea, and cyanuric acid are typically vaporized, activated by passage over a hot metal oxide catalyst, and directly reacted with the exhaust gas stream. The gas mixture is typically held for a short period to permit the reaction to go to completion. As cyanuric acid systems provide the greatest reduction in $NO_x$ emissions, they will be described to illustrate the mechanisms of this group of related technologies.

Cyanuric acid systems, which can decrease $NO_x$ by two orders of magnitude, are currently marketed under the names "RAPRENO$_x$" and "NO$_x$ TECH", respectively, by Robert Perry and by Cummins Engine Company. As disclosed in U.S. Pat. Nos. 4,731,231 and 4,886,650 to Perry, a typical system involves vaporization of cyanuric acid followed by catalytic activation of the resultant isocyanate stream. After a 1 second holding period at 1200° F., the reaction is complete. Perry postulates a complicated series of chain reactions initiated by the isocyanate radical. (Similar reaction cascades exist for other nitrogen compounds.) A typical "RAPRENO$_x$" installation includes a stationary engine, a cyanuric acid powder metering device, and a gas holding tank. This system adjusts slowly to changes in engine emissions.

Cummins Engine Company simplified this process by directly mixing cyanuric acid into the engine exhaust without prevaporization. However, a holding tank is still required to permit the reaction cascade to go to completion.

Fuels which either incorporated emissions control compounds or which, as a result of their composition, change combustion conditions, could be effective in management of $NO_x$ emissions from mobile systems. Several strategies have been developed for synthesis of emissions control fuels. California has mandated specific composition ranges for petroleum-based diesel fuels. Nitrogen, sulfur, and aromatic contents of these fuels are limited while ignition delay is minimized. Microemulsion compositions which minimize emissions by increasing fuel oxygenate content have also been described by Hazbun et al. (U.S. Pat. No. 4,744,796) and Schon et al. (U.S. Pat. No. 5,004,479).

Although fuels which contain cyanuric acid is nearly insoluble in hydrocarbons typical of diesel fuel. Several strategies have been developed to improve the solubility of cyanuric acid or related triazines. Sung et al. (U.S. Pat. No. 5,219,955) disclose the direct incorporation of s-triazines into diesel fuel for emissions control. The inventors postulate that "thermal unzipping of free hydroxyl groups on s-triazines will generate the $NO_x$ reducing agent, isocyanic acid [Column 3, lines 38–40]." However, synthesis of s-triazines is complicated. The portions of the molecule which permit dissolution and which provide protection during the early stages of combustion increase the weight of material needed to reduce a given amount of $NO_x$. The utility of this material in decreasing $NO_x$ emissions from conventional mobile diesel engines has not been demonstrated.

SUMMARY OF THE INVENTION

The subject invention, by incorporating features from the previously described technologies, provides an effective method for controlling $NO_x$ emissions from mobile and stationary diesel engines.

It is therefore an object of the invention to provide a method for reducing $NO_x$ emissions produced by engines, without modifying the structure of currently existing engines.

It is another object of the invention to reduce $NO_x$ emissions by adding a small amount of urea, urea-based compound (such as ethyl urea) or a triazine compound to a middle distillate base constituent.

It is also another object of the invention to incorporate a microemulsion of urea or urea-based compound or a triazine compound directly into the base constituent.

Another object of the invention is to reduce $NO_x$ emissions produced by existing engines by providing a fuel composition containing small amounts of a microemulsion of urea, urea-based compound or a triazine compound.

These and other objects are achieved by the subject invention which comprises a fuel composition providing reduced $NO_x$ emissions from combustion. The fuel includes a microemulsion of an effective amount of an additive constituent, including urea, urea-based compound, or a triazine compound, added to a middle distillate base constituent, such as diesel fuel. Generally, the base constituent contains less than about 1% of urea, urea-based compound or a triazine compound by volume. As part of manufacturing the subject fuel, a microemulsion of the urea or triazine compound may be created by mixing either material with t-butyl alcohol, water, oleic acid, and ethanolamine.

By adding a small amount of a microemulsion of urea or a triazine compound to the base constituent, the subject invention decreases the $NO_x$ emissions produced by currently existing engines. Other objects, advantages and salient features of the invention will become apparent from the following detailed description, which discloses a preferred but non-limiting embodiment of the invention.

DETAILED DESCRIPTION OF THE INVENTION

As previously discussed, the Clean Air Act mandates decreases in the $NO_x$ emissions produced by diesel engines used in transport and power generation. The subject invention makes it possible to decrease $NO_x$ emissions by adding a small amount, preferably less than about 10%, of an additive constituent including urea or a triazine compound (methylol melamines, melamine cyanurates, etc.) to a middle distillate base constituent, such as diesel fuel. It should be noted that diesel fuel is only one of many middle distillate base constituents that can be used in accordance with the subject invention.

As the art is well aware, a variety of triazine compounds are readily available. In one embodiment of the subject invention methylol melamine synthesized by reacting formaldehyde with melamine in basic solution has been used, and has shown positive results. Additionally, mono-, di-, and trimethylol melamine have been utilized in accordance with the subject invention. However, any triazine compound that functions within the spirit of the subject invention may be used to produce fuel in accordance with the subject invention.

Since the triazine compounds used in accordance with the subject invention and urea are typically not soluble in middle distillate base constituents such as diesel fuel, microemulsion technology is used to suspend or dissolve the urea and triazine compound in the base constituent. Specifically, urea or a selected triazine compound is mixed with other materials which facilitate the incorporation of the urea or triazine compound into a microemulsion. A variety of mixtures are known within the art for producing a microemulsion within middle distillate base constituents.

It may also be possible to use urea or a triazine compound in extremely fine form which may not require the presence of an emulsifying agent.

Engine Test Procedure

The engine used for fuel screening was a Deutz F1L-511W single cylinder, indirect injection diesel engine with 0.824 liter displacement and 19:1 compression ratio, coupled to water-cooled eddy current dynamometer. Procedures as described in SAE paper 902101 were used to estimate cetane of fuels, if needed. During emissions tests, engine speed, torque, fuel flow, and $NO_x$ were measured. Air flow was calculated from inclined manometer readings using the manufacturer's equation and a calibration curve. The Beckman 951 $NO/NO_x$ analyzer, mounted inside a Beckman cabinet with sample pump, dryer, and filters, was periodically recalibrated using a gas of known composition. The Beckman analyzer provides measurements of NO or $NO_x$ in ppm. Tests on a standardized emissions control fuel, Phillips D2, were performed during each set of emissions tests. Additionally, Amoco premier diesel fuel and dodecane, which were used as blending bases, were also evaluated.

EXAMPLE 1.

0.5% Methylol Melamine

The following materials were mixed to prepare a fuel: 5 g methylol melamine, 45 g water, 50 g t-butyl alcohol, 90 g oleic acid, log ethanolamine, 800 g Phillips D2 emissions test diesel fuel, and 10 mg Mach I Superfine alpha $Fe_2O_3$ catalyst. After mixing, the fuel was filtered to remove any large catalyst particles. Emissions performance was then determined in the Deutz engine. The following results were obtained (See Table 1).

EXAMPLE 2.

0.5% Urea

The following materials were mixed to prepare a fuel: 5 g urea, 45 g water, 50 g t-butyl alcohol, 90 g oleic acid, log ethanolamine, 800 g Phillips D2 emissions test diesel fuel, and 10 mg Mach I Superfine alpha $Fe_2O_3$ catalyst. After mixing, the fuel was filtered to remove any large catalyst particles. Emissions performance was then determined in the Deutz engine. The following results were obtained (See Table 2a).

Conventional Fuel Performance for Examples 1 and 2

Emissions from the Deutz engine burning Phillips D2 emissions control fuel were evaluated to provide a base emissions level (See Table 2a).

EXAMPLE 3.

1% Astro Aricel PC-6N

The following materials were mixed to prepare a fuel: 20 g Astro Aricel PC-6N, 50 g water, 142 g t-butyl alcohol, 180 g oleic acid, 8 g ethanolamine, and 1600 g Amoco premier diesel fuel. Emissions performance was then determined in the Deutz engine. The following results were obtained (See Table 3).

EXAMPLE 4.

2.5% Astro Aricel PC-6N

The following materials were mixed to prepare a fuel: 50 g Astro Aricel PC-6N, 50 g water, 143 g t-butyl alcohol, 180 g oleic acid, 7 g ethanolamine, and 1570 g Amoco premier diesel fuel. Emissions performance was then determined in the Deutz engine. The following results were obtained (See Table 4).

EXAMPLE 5.

2.5% Astro Aricel PC-6N with Catalyst

To 500 g of the fuel of Example 4 was added 10 mg of Mach I superfine alpha $Fe_2O_3$ catalyst. Emissions performance was then determined in the Deutz engine. The following results were obtained (See Table 5).

EXAMPLE 6.

1.0% Astro Aricel PC-6N with Catalyst

To 500 g of the fuel of Example 3 was added 10 mg of Mach I superfine alpha $Fe_2O_3$ catalyst. Emissions performance was then determined in the Deutz engine. The following results were obtained (See Table 6).

EXAMPLE 7.

1% Urea

The following materials were mixed to prepare a fuel: 20 g urea, 100 g water, 100 g t-butyl alcohol, 180 g oleic acid, 20 g ethanolamine, and 1580 g Amoco premier diesel fuel. Emissions performance was then determined in the Deutz engine. The following results were obtained (See Table 7).

EXAMPLE 8.

2.5% Urea

The following materials were mixed to prepare a fuel: 50 g urea, 100 g water, 100 g t-butyl alcohol, 180 g oleic acid, 20 g ethanolamine, and 1550 g Amoco premier diesel fuel. Emissions performance was then determined in the Deutz engine. The following results were obtained (See Table 8).

EXAMPLE 9.

1.75% Urea

Equal weights of the fuels in Examples 7 and 8 were blended to give a fuel containing 1.75% urea. Emissions performance was then determined in the Deutz engine. The following results were obtained (See Table 9).

EXAMPLE 10.

2.5% Urea with Catalyst

To 500 g of the fuel of Example 8 was added 10 mg of Mach I superfine alpha $Fe_2O_3$ catalyst. Emissions performance was then determined in the Deutz engine. The following results were obtained (See Table 10).

EXAMPLE 11.

1% Urea with Catalyst

To 500 g of the fuel of Example 7 was added 10 mg of Mach I superfine alpha $Fe_2O_3$ catalyst. Emissions performance was then determined in the Deutz engine. The following results were obtained (See Table 11).

Conventional Fuel Performance for Examples 3 through 11

Emissions from the Deutz engine burning Phillips D2 emissions control fuel and Amoco premier diesel were evaluated to provide base emissions levels (See Table 11a).

EXAMPLE 12.

4% Astro Aricel PC-6N and 2.5% Urea

The following materials were mixed to prepare a fuel: 40 g Astro Aricel PC-6N, 40 g water, 25 g urea, 50 g t-butyl alcohol, 94 g oleic acid, 75 g Kessco 792, 6.6 g ethanolamine, and 669 g Amoco premier diesel fuel. Emissions performance was then determined in the Deutz engine. The following results were obtained (See Table 12). Kessco 792 is made by the Stepan Company of Maywood, N.J., and is diethylene glycol dioctanoate.

EXAMPLE 13.

5% Astro Celrez LA-4M-HS and 2.5% Urea

The following materials were mixed to prepare a fuel: 50 g Astro Celrez LA-4M-HS, 40 g water, 25 g urea, 50 g t-butyl alcohol, 94 g oleic acid, 75 g Kessco 792, 6.6 g ethanolamine, and 659 g Amoco premier diesel fuel. Emissions performance was then determined in the Deutz engine. The following results were obtained (See Table 13).

EXAMPLE 14.

2.5% Astro Aricel PC-6N and 2% Urea

The following materials were mixed to prepare a fuel: 2.5 g Astro Aricel PC-6N, 40 g water, 20 g urea, 50 g t-butyl alcohol, 94 g oleic acid, 75 g Kessco 792, 6.6 g ethanolamine, and 669 g Amoco premier diesel fuel. Emissions performance was then determined in the Deutz engine. The following results were obtained (See Table 14).

EXAMPLE 15.

1.25% Astro Aricel PC-6N, and 2.5% Astro Celrez LA-4M-HS

Equal weights of the fuels in Examples 4 and 13 were blended to give a fuel containing 1.75% urea. Emissions performance was then determined in the Deutz engine. The following results were obtained (See Table 15).

Conventional Fuel Performance for Examples 12 through 15

Emissions from the Deutz engine burning Phillips D2 emissions control fuel was evaluated to provide a base emissions level (See Table 15a).

EXAMPLE 16.

2% Ethylurea

The following materials were mixed to prepare a fuel: 2% ethylurea, 15% t-butyl alcohol, 5% water, 13% oleic acid, 2.5% ethanolamine, 62.5% Amoco premier diesel fuel. Emissions performance was then determined in the Deutz engine. The following results were obtained (See Table 16).

EXAMPLE 17.

2% n-t-Butylurea

The following materials were mixed to prepare a fuel: 2% n-t-butylurea, 15% t-butyl alcohol, 5% water, 13% oleic acid, 2.5% ethanolamine, 62.5% Amoco premier diesel fuel. Emissions performance was then determined in the Deutz engine. The following results were obtained (See Table 17).

EXAMPLE 18.

Microemulsion Blending Base

The following materials were mixed to prepare a fuel: 15% t-butyl alcohol, 5% water, 13% oleic acid, 2.5% ethanolamine, 64.5% Amoco premier diesel fuel. Emissions performance was then determined in the Deutz engine. The following results were obtained (See Table 18).

Conventional Fuel Performance for Examples 16 through 18

Emissions from the Deutz engine burning Phillips D2 emissions control fuel was evaluated to provide a base emissions level (See Table 18a).

Synthesis of Methylol Melamine

Methylol melamine was made by reacting 1M melamine with 2M formaldehyde in basic solution. The residue was then dissolved in 1:4 isopropanol:water, filtered through a Whatman GF/A filter, and the filtrate lyophilized.

TABLE 1

0.5% Methylol Melamine

| Fuel ID | Speed RPM | Torque lb-ft | Fuel flow s/10 cc | Inc. man. Inches Water | Air, cf/min | $NO_x$ ppm | $EINO_x$ g $NO_x$/kg fuel |
|---|---|---|---|---|---|---|---|
| 90 | 1398 | 14.3 | 30.13 | 1.18 | 16.05 | 845 | 43.50 |
| 90 | 1372 | 9.8 | 36.56 | 1.17 | 15.91 | 670 | 41.46 |
| 90 | 1435 | 5 | 46 | 1.24 | 16.85 | 350 | 28.83 |
| 90 | 1407 | 0 | 69.38 | 1.22 | 16.59 | 170 | 20.76 |
| 90 | 1399 | 14.8 | 29.12 | 1.2 | 16.32 | 870 | 44.01 |
| 90 | 1925 | 18.5 | 19.1 | 1.78 | 24.09 | 425 | 20.83 |

TABLE 2

0.5% Urea

| Fuel ID | Speed RPM | Torque lb-ft | Fuel flow s/10 cc | Inc. man. Inches Water | Air, cf/min | $NO_x$ ppm | $EINO_x$ g $NO_x$/kg fuel |
|---|---|---|---|---|---|---|---|
| 91 | 1978 | 18.8 | 18.09 | 1.74 | 23.56 | 370 | 16.80 |
| 91 | 1955 | 14.8 | 21.12 | 1.74 | 23.56 | 300 | 15.89 |
| 91 | 1425 | 14.5 | 28.35 | 1.22 | 16.59 | 540 | 27.04 |
| 91 | 1320 | 10.4 | 34.09 | 1.23 | 16.72 | 470 | 28.50 |
| 91 | 1433 | 5 | 46.06 | 1.24 | 16.85 | 250 | 20.62 |
| 91 | 1414 | 0 | 67.69 | 1.23 | 16.72 | 125 | 15.01 |
| 91 | 1402 | 5.3 | 44.88 | 1.22 | 16.59 | 265 | 20.96 |
| 91 | 1470 | 10.4 | 33.37 | 1.24 | 16.85 | 370 | 22.14 |
| 91 | 1421 | 15.1 | 27.31 | 1.22 | 16.59 | 495 | 23.88 |

Conventional Fuel Performance for Table 2a

| Fuel ID | Speed RPM | Torque lb-ft | Fuel flow s/10 cc | Inc. man. Inches Water | Air, cf/min | $NO_x$ ppm | $EINO_x$ g $NO_x$/kg fuel |
|---|---|---|---|---|---|---|---|
| Phillips | 1966 | 8.2 | 32.99 | 1.78 | 24.09 | 450 | 37.99 |
| Phillips | 1947 | 10 | 29.99 | 1.76 | 23.82 | 490 | 37.21 |
| Phillips | 1950 | 15 | 23.94 | 1.76 | 23.82 | 600 | 36.40 |
| Phillips | 1983 | 19 | 19.49 | 1.75 | 23.69 | 620 | 30.49 |
| Phillips | 1400 | 5 | 53.48 | 1.18 | 16.05 | 560 | 51.04 |
| Phillips | 1400 | 10 | 40.44 | 1.2 | 16.32 | 650 | 45.59 |
| Phillips | 1400 | 15 | 32.27 | 1.2 | 16.32 | 810 | 45.39 |

TABLE 3

1% Astro Aricel PC-6N

| Fuel ID | Speed RPM | Torque lb-ft | Fuel flow s/10 cc | Inc. man. Inches Water | Air, cf/min | NO ppm | $EINO_x$ g $NO_x$/kg fuel |
|---|---|---|---|---|---|---|---|
| 103 | 1955 | 5.4 | 35.6 | 1.76 | 23.82 | 220 | 19.6 |
| 103 | 1955 | 9.9 | 28.5 | 1.76 | 23.82 | 245 | 17.5 |
| 103 | 1955 | 14.8 | 22.1 | 1.74 | 23.56 | 310 | 17.1 |
| 103 | 1963 | 20.0 | 17.7 | 1.72 | 23.29 | 420 | 18.3 |
| 103 | 1949 | 14.9 | 22.4 | 1.72 | 23.29 | 355 | 19.5 |
| 103 | 1951 | 9.9 | 28.6 | 1.74 | 23.56 | 245 | 17.4 |
| 103 | 1951 | 5.1 | 38.4 | 1.75 | 23.69 | 210 | 20.1 |

TABLE 4

2.5% Astro Aricel PC-6N

| Fuel ID | Speed RPM | Torque lb-ft | Fuel flow s/10 cc | Inc. man. Inches Water | Air, cf/min | NO ppm | $EINO_x$ g $NO_x$/kg fuel |
|---|---|---|---|---|---|---|---|
| 100 | 1959 | 5.3 | 36.0 | 1.77 | 23.96 | 205 | 18.6 |
| 100 | 1949 | 9.9 | 28.2 | 1.76 | 23.82 | 235 | 16.6 |
| 100 | 1948 | 15.0 | 21.4 | 1.73 | 23.42 | 280 | 14.8 |
| 100 | 1964 | 19.7 | 17.6 | 1.74 | 23.56 | 365 | 16.0 |
| 100 | 1946 | 15.2 | 22.2 | 1.72 | 23.29 | 370 | 20.2 |

TABLE 5

2.5% Astro Aricel PC-6N with Catalyst

| Fuel ID | Speed RPM | Torque lb-ft | Fuel flow s/10 cc | Inc. man. Inches Water | Air, cf/min | NO ppm | $EINO_x$ g $NO_x$/kg fuel |
|---|---|---|---|---|---|---|---|
| 105 | 1955 | 5.0 | 36.7 | 1.76 | 23.82 | 220 | 20.2 |
| 105 | 1956 | 9.9 | 28.2 | 1.76 | 23.82 | 235 | 16.6 |
| 105 | 1952 | 14.6 | 22.3 | 1.74 | 23.56 | 310 | 17.2 |
| 105 | 1952 | 20.0 | 17.4 | 1.73 | 23.42 | 400 | 17.2 |
| 105 | 1960 | 15.0 | 21.4 | 1.74 | 23.56 | 330 | 17.5 |
| 105 | 1962 | 10.0 | 27.3 | 1.74 | 23.56 | 335 | 22.7 |
| 105 | 1947 | 5.1 | 37.1 | 1.74 | 23.56 | 250 | 23.0 |

TABLE 6

2.5% Astro Aricel PC-6N with Catalyst

| Fuel ID | Speed RPM | Torque lb-ft | Fuel flow s/10 cc | Inc. man. Inches Water | Air, cf/min | NO ppm | $EINO_x$ g $NO_x$/kg fuel |
|---|---|---|---|---|---|---|---|
| 108 | 1945 | 5.2 | 36.4 | 1.78 | 24.09 | 195 | 18.0 |
| 108 | 1952 | 10.1 | 27.4 | 1.76 | 23.82 | 210 | 14.5 |
| 108 | 1958 | 14.9 | 22.0 | 1.74 | 23.56 | 330 | 18.0 |
| 108 | 1950 | 19.8 | 17.5 | 1.72 | 23.29 | 410 | 17.7 |
| 108 | 1953 | 15.1 | 22.0 | 1.72 | 23.29 | 310 | 16.8 |
| 108 | 1960 | 10.2 | 27.7 | 1.74 | 23.56 | 260 | 17.9 |
| 108 | 1945 | 5.0 | 38.1 | 1.74 | 23.56 | 205 | 19.3 |

TABLE 7

1% Urea

| Fuel ID | Speed RPM | Torque lb-ft | Fuel flow s/10 cc | Inc. man. Inches Water | Air, cf/min | NO ppm | $EINO_x$ g $NO_x$/kg fuel |
|---|---|---|---|---|---|---|---|
| 102 | 1964 | 5.4 | 35.5 | 1.75 | 23.69 | 240 | 21.2 |
| 102 | 1946 | 9.8 | 27.5 | 1.74 | 23.56 | 260 | 17.7 |
| 102 | 1963 | 15.0 | 21.6 | 1.74 | 23.56 | 320 | 17.2 |
| 102 | 1966 | 19.8 | 17.1 | 1.74 | 23.56 | 405 | 17.3 |
| 102 | 1951 | 15.1 | 21.4 | 1.72 | 23.29 | 360 | 19.0 |
| 102 | 1953 | 10.2 | 27.7 | 1.74 | 23.56 | 270 | 18.6 |
| 102 | 1958 | 5.3 | 36.3 | 1.75 | 23.69 | 230 | 20.8 |

TABLE 8

2.5% Urea

| Fuel ID | Speed RPM | Torque lb-ft | Fuel flow s/10 cc | Inc. man. Inches Water | Air, cf/min | NO ppm | $EINO_x$ g $NO_x$/ kg fuel |
|---|---|---|---|---|---|---|---|
| 101 | 1960 | 5.1 | 35.0 | 1.74 | 23.56 | 250 | 21.7 |
| 101 | 1959 | 10.1 | 27.0 | 1.74 | 23.56 | 280 | 18.8 |
| 101 | 1959 | 15.2 | 20.9 | 1.72 | 23.29 | 370 | 19.1 |
| 101 | 1953 | 19.9 | 17.0 | 1.70 | 23.02 | 455 | 18.8 |
| 101 | 1954 | 15.1 | 21.2 | 1.70 | 23.02 | 385 | 19.8 |
| 101 | 1958 | 10.2 | 26.8 | 1.72 | 23.29 | 305 | 20.1 |
| 101 | 1943 | 5.2 | 35.9 | 1.72 | 23.29 | 260 | 22.9 |

TABLE 9

1.75% Urea

| Fuel ID | Speed RPM | Torque lb-ft | Fuel flow s/10 cc | Inc. man. Inches Water | Air, cf/min | NO ppm | $EINO_x$ g $NO_x$/ kg fuel |
|---|---|---|---|---|---|---|---|
| 104 | 1950 | 5.2 | 36.2 | 1.76 | 23.82 | 250 | 22.7 |
| 104 | 1958 | 10.2 | 27.1 | 1.76 | 23.82 | 280 | 19.1 |
| 104 | 1945 | 14.9 | 21.8 | 1.75 | 23.69 | 345 | 18.8 |
| 104 | 1955 | 14.9 | 21.1 | 1.75 | 23.69 | 350 | 18.4 |
| 104 | 1943 | 9.9 | 27.5 | 1.74 | 23.56 | 290 | 19.8 |
| 104 | 1955 | 5.1 | 36.8 | 1.75 | 23.69 | 245 | 22.5 |

TABLE 10

2.5% Urea with Catalyst

| Fuel ID | Speed RPM | Torque lb-ft | Fuel flow s/10 cc | Inc. man. Inches Water | Air, cf/min | NO ppm | $EINO_x$ g $NO_x$/ kg fuel |
|---|---|---|---|---|---|---|---|
| 106 | 1957 | 5.1 | 35.6 | 1.77 | 23.96 | 230 | 20.6 |
| 106 | 1946 | 10.0 | 27.3 | 1.75 | 23.69 | 265 | 18.1 |
| 106 | 1959 | 14.7 | 21.3 | 1.75 | 23.69 | 340 | 18.1 |
| 106 | 1960 | 20.2 | 16.8 | 1.74 | 23.56 | 425 | 17.8 |
| 106 | 1952 | 15.1 | 21.2 | 1.72 | 23.29 | 370 | 19.3 |
| 106 | 1958 | 10.0 | 27.1 | 1.74 | 23.56 | 295 | 19.8 |
| 106 | 1949 | 5.3 | 35.5 | 1.74 | 23.56 | 240 | 21.1 |

TABLE 11

1% Urea with Catalyst

| Fuel ID | Speed RPM | Torque lb-ft | Fuel flow s/10 cc | Inc. man. Inches Water | Air, cf/min | NO ppm | $EINO_x$ g $NO_x$/ kg fuel |
|---|---|---|---|---|---|---|---|
| 107 | 1952 | 5.2 | 36.5 | 1.78 | 24.09 | 215 | 19.9 |
| 107 | 1957 | 10.1 | 27.2 | 1.76 | 23.82 | 255 | 17.4 |
| 107 | 1958 | 14.8 | 21.4 | 1.74 | 23.56 | 325 | 17.3 |
| 107 | 1958 | 20.0 | 16.9 | 1.73 | 23.42 | 415 | 17.4 |
| 107 | 1953 | 15.4 | 21.7 | 1.72 | 23.29 | 355 | 18.9 |
| 107 | 1955 | 10.2 | 27.1 | 1.72 | 23.29 | 275 | 18.3 |
| 107 | 1953 | 5.3 | 36.0 | 1.74 | 23.56 | 240 | 21.4 |

TABLE 11a

Conventional Fuel Performance for Examples 3 through 11

| Fuel ID | Speed RPM | Torque lb-ft | Fuel flow s/10 cc | Inc. man. Inches Water | Air, cf/min | NO ppm | $EINO_x$ g $NO_x$/ kg fuel |
|---|---|---|---|---|---|---|---|
| Phillips | 1948 | 5.0 | 39.8 | 1.76 | 23.82 | 285 | 28.4 |
| Phillips | 1964 | 10.2 | 28.9 | 1.76 | 23.82 | 340 | 24.6 |
| Phillips | 1957 | 15.9 | 22.3 | 1.75 | 23.69 | 415 | 23.1 |
| Phillips | 1956 | 20.0 | 18.2 | 1.73 | 23.42 | 485 | 21.8 |
| Phillips | 1960 | 15.9 | 22.0 | 1.73 | 23.42 | 455 | 24.7 |
| Phillips | 1955 | 10.4 | 29.2 | 1.74 | 23.56 | 360 | 26.0 |
| Phillips | 1952 | 5.2 | 36.5 | 1.76 | 23.82 | 255 | 23.3 |
| Phillips | 1955 | 15.1 | 22.3 | 1.74 | 23.56 | 440 | 24.4 |
| Phillips | 1944 | 10.0 | 28.9 | 1.70 | 23.02 | 360 | 25.2 |
| Phillips | 1957 | 5.4 | 36.6 | 1.72 | 23.29 | 280 | 25.1 |
| Phillips | 1958 | 5.2 | 39.1 | 1.76 | 23.82 | 270 | 26.5 |
| Phillips | 1960 | 10.0 | 30.5 | 1.75 | 23.69 | 310 | 23.6 |
| Phillips | 1956 | 14.8 | 23.8 | 1.74 | 23.56 | 370 | 21.9 |
| Phillips | 1952 | 20.0 | 19.1 | 1.72 | 23.29 | 460 | 21.6 |
| Phillips | 1944 | 15.0 | 23.6 | 1.72 | 23.29 | 410 | 23.8 |
| Phillips | 1957 | 10.2 | 30.2 | 1.73 | 23.42 | 385 | 28.6 |
| Phillips | 1947 | 5.2 | 40.1 | 1.74 | 23.56 | 300 | 29.8 |
| Amoco PD | 1949 | 5.1 | 39.7 | 1.75 | 23.69 | 240 | 23.7 |
| Amoco PD | 1955 | 10.1 | 29.7 | 1.75 | 23.69 | 305 | 22.5 |
| Amoco PD | 1949 | 15.0 | 23.7 | 1.74 | 23.56 | 380 | 22.3 |
| Amoco PD | 1956 | 20.0 | 18.9 | 1.74 | 23.56 | 420 | 19.7 |
| Amoco PD | 1958 | 15.3 | 22.7 | 1.73 | 23.42 | 390 | 21.8 |
| Amoco PD | 1960 | 10.1 | 29.8 | 1.74 | 23.56 | 330 | 24.4 |
| Amoco PD | 1955 | 5.1 | 40.1 | 1.74 | 23.56 | 270 | 26.8 |

TABLE 12

4% Astro Aricel PC-6N and 2.5% Urea

| Fuel ID | Speed RPM | Torque lb-ft | Fuel flow s/10 cc | Inc. man. Inches Water | Air, cf/min | NO ppm | $EINO_x$ g $NO_x$/ kg fuel |
|---|---|---|---|---|---|---|---|
| 109 | 1955 | 5.2 | 34.5 | 1.76 | 23.82 | 230 | 19.90 |
| 109 | 1954 | 9.9 | 26.8 | 1.75 | 23.69 | 275 | 18.41 |
| 109 | 1955 | 14.9 | 21.4 | 1.74 | 23.56 | 335 | 17.84 |
| 109 | 1953 | 19.6 | 17.4 | 1.72 | 23.29 | 395 | 16.90 |
| 109 | 1945 | 15.0 | 22.3 | 1.72 | 23.29 | 345 | 18.92 |
| 109 | 1952 | 10.2 | 26.9 | 1.73 | 23.42 | 280 | 18.63 |
| 109 | 1957 | 4.9 | 34.8 | 1.75 | 23.69 | 220 | 19.10 |

TABLE 13

5% Astro Celrez LA-4M-HS and 2.5% Urea

| Fuel ID | Speed RPM | Torque lb-ft | Fuel flow s/10 cc | Inc. man. Inches Water | Air, cf/min | NO ppm | $EINO_x$ g $NO_x$/ kg fuel |
|---|---|---|---|---|---|---|---|
| 110 | 1953 | 5.0 | 34.6 | 1.76 | 23.82 | 210 | 18.21 |
| 110 | 1958 | 10.0 | 26.2 | 1.75 | 23.69 | 255 | 16.68 |
| 110 | 1951 | 15.0 | 20.5 | 1.74 | 23.56 | 340 | 17.36 |
| 110 | 1963 | 20.1 | 16.3 | 1.72 | 23.29 | 425 | 17.11 |
| 110 | 1964 | 15.0 | 21.0 | 1.74 | 23.56 | 375 | 19.59 |
| 110 | 1949 | 10.1 | 26.7 | 1.73 | 23.42 | 300 | 19.75 |
| 110 | 1960 | 4.9 | 35.1 | 1.74 | 23.56 | 250 | 21.76 |

TABLE 14

2.5% Astro Aricel PC-6N and 2% Urea

| Fuel ID | Speed RPM | Torque lb-ft | Fuel flow s/10 cc | Inc. man. Inches Water | Air, cf/min | NO ppm | $EINO_x$ g $NO_x$/ kg fuel |
|---|---|---|---|---|---|---|---|
| 111 | 1945 | 5.3 | 34.6 | 1.75 | 23.69 | 215 | 18.55 |
| 111 | 1948 | 10.1 | 26.6 | 1.74 | 23.56 | 280 | 18.49 |
| 111 | 1959 | 14.8 | 21.2 | 1.74 | 23.56 | 350 | 18.42 |
| 111 | 1947 | 19.4 | 17.5 | 1.73 | 23.42 | 425 | 18.39 |
| 111 | 1947 | 15.2 | 21.2 | 1.73 | 23.42 | 390 | 20.44 |
| 111 | 1965 | 10.1 | 26.5 | 1.75 | 23.69 | 310 | 20.54 |
| 111 | 1955 | 5.1 | 35.4 | 1.75 | 23.69 | 270 | 23.84 |

TABLE 15

1.25% Astro Aricel PC-6N, and 2.5% Astro Celrez LA-4M-HS

| Fuel ID | Speed RPM | Torque lb-ft | Fuel flow s/10 cc | Inc. man. Inches Water | Air, cf/min | NO ppm | $EINO_x$ g $NO_x$/ kg fuel |
|---|---|---|---|---|---|---|---|
| 112 | 1953 | 5.1 | 35.5 | 1.75 | 23.69 | 210 | 18.61 |
| 112 | 1955 | 10.1 | 26.8 | 1.75 | 23.69 | 250 | 16.70 |
| 112 | 1956 | 15.1 | 20.9 | 1.74 | 23.56 | 320 | 16.60 |
| 112 | 1960 | 19.8 | 16.9 | 1.73 | 23.42 | 400 | 16.78 |
| 112 | 1943 | 15.2 | 21.0 | 1.72 | 23.29 | 360 | 18.62 |
| 112 | 1949 | 10.0 | 27.1 | 1.73 | 23.42 | 275 | 18.42 |
| 112 | 1949 | 5.0 | 35.8 | 1.74 | 23.56 | 230 | 20.41 |

TABLE 15a

Conventional Fuel Performance for Examples 12 through 15

| Fuel ID | Speed RPM | Torque lb-ft | Fuel flow s/10 cc | Inc. man. Inches Water | Air, cf/min | NO ppm | $EINO_x$ g $NO_x$/ kg fuel |
|---|---|---|---|---|---|---|---|
| Phillips | 1944 | 5.2 | 37.5 | 1.76 | 23.82 | 260 | 24.45 |
| Phillips | 1945 | 10.0 | 28.8 | 1.75 | 23.69 | 305 | 21.94 |
| Phillips | 1952 | 15.2 | 22.6 | 1.73 | 23.42 | 400 | 22.28 |
| Phillips | 1956 | 19.8 | 18.0 | 1.72 | 23.29 | 460 | 20.38 |
| Phillips | 1948 | 15.1 | 22.9 | 1.72 | 23.29 | 430 | 24.12 |
| Phillips | 1946 | 10.4 | 29.1 | 1.73 | 23.42 | 350 | 25.10 |
| Phillips | 1950 | 5.1 | 39.8 | 1.74 | 23.56 | 270 | 26.58 |

TABLE 16

2% Ethylurea

| Fuel ID | Speed RPM | Torque lb-ft | Fuel flow s/10 cc | Inc. man. Inches Water | Air, cf/min | $NO_x$ ppm | $EINO_x$ g $NO_x$/ kg fuel |
|---|---|---|---|---|---|---|---|
| 205 | 1945 | 5.0 | 14.74 | 1.74 | 23.56 | 445 | 32.56 |
| 205 | 1951 | 10.0 | 11.64 | 1.74 | 23.56 | 485 | 28.06 |
| 205 | 1969 | 14.9 | 9.62 | 1.74 | 23.56 | 505 | 24.18 |
| 205 | 1955 | 19.8 | 7.80 | 1.73 | 23.42 | 460 | 17.79 |

TABLE 17

2% N-t-Butylurea

| Fuel ID | Speed RPM | Torque lb-ft | Fuel flow s/10 cc | Inc. man. Inches Water | Air, cf/min | $NO_x$ ppm | $EINO_x$ g $NO_x$/ kg fuel |
|---|---|---|---|---|---|---|---|
| 206 | 1957 | 5.2 | 15.95 | 1.77 | 23.96 | 415 | 33.40 |
| 206 | 1952 | 9.9 | 12.47 | 1.75 | 23.69 | 755 | 47.05 |
| 206 | 1969 | 14.9 | 10.09 | 1.75 | 23.69 | 815 | 41.15 |
| 206 | 1950 | 19.7 | 8.34 | 1.75 | 23.69 | 615 | 25.70 |
| 206 | 1940 | 15.1 | 10.33 | 1.72 | 23.29 | 950 | 48.27 |

TABLE 18

Microemulsion Blending Base

| Fuel ID | Speed RPM | Torque lb-ft | Fuel flow s/10 cc | Inc. man. Inches Water | Air, cf/min | $NO_x$ ppm | $EINO_x$ g $NO_x$/ kg fuel |
|---|---|---|---|---|---|---|---|
| 207 | 1963 | 5.4 | 16.94 | 1.77 | 23.96 | 450 | 38.46 |
| 207 | 1949 | 9.8 | 13.11 | 1.76 | 23.82 | 730 | 48.08 |
| 207 | 1950 | 14.8 | 10.42 | 1.73 | 23.42 | 1100 | 56.70 |
| 207 | 1956 | 19.2 | 8.69 | 1.72 | 23.29 | 1150 | 49.22 |
| 207 | 1950 | 15.1 | 10.31 | 1.72 | 23.29 | 1100 | 55.79 |
| 207 | 1950 | 10.0 | 13.27 | 1.73 | 23.42 | 800 | 52.43 |
| 207 | 1950 | 5.1 | 17.45 | 1.70 | 23.02 | 500 | 42.30 |

TABLE 18a

Conventional Fuel Performance for Examples 16 through 18

| Fuel ID | Speed RPM | Torque lb-ft | Fuel flow s/10 cc | Inc. man. Inches Water | Air, cf/min | $NO_x$ ppm | $EINO_x$ g $NO_x$/ kg fuel |
|---|---|---|---|---|---|---|---|
| Phillips | 1964 | 5.0 | 19.73 | 1.76 | 23.82 | 620 | 61.28 |
| Phillips | 1953 | 10.0 | 14.16 | 1.74 | 23.56 | 1250 | 87.79 |
| Phillips | 1943 | 15.0 | 11.06 | 1.74 | 23.56 | 1450 | 79.63 |
| Phillips | 1955 | 19.8 | 9.44 | 1.72 | 23.29 | 1300 | 60.30 |
| Phillips | 1945 | 14.9 | 11.30 | 1.71 | 23.16 | 1450 | 79.98 |
| Phillips | 1949 | 9.9 | 14.64 | 1.72 | 23.29 | 1288 | 92.42 |
| Phillips | 1944 | 5.1 | 19.27 | 1.73 | 23.42 | 760 | 72.15 |

The subject invention is expected to find use in heavy diesel engines used for transport or power generation. It is expected that the subject invention will be used in areas where emission management is critical and where a cost effective emissions control method is needed. Although the market for the technology encompassing the subject invention is the direct result of a federal mandate, the new Clean Air Act, government use of the technology is expected only where government owned diesel engines require $NO_x$ emissions control.

The AriCel PC-6N referred to in the above Examples is made by ASTRO INDUSTRIES of Morganton, N.C. (a division of Borden, Inc.). It is a methylated melamine formaldehyde resin, which is completely soluble in water.

The foregoing Examples use different percentages of additive constituents. Preferred ranges for the urea, urea-based compounds and triazine compounds are between less than 1% to about 6.5%.

While advantageous embodiments have been chosen to illustrate the subject invention, it will be understood by those skilled in the out that various changes and modifications can be made therein without departing from the scope of the invention as defined in the appended claims.

What is claimed is:

1. A fuel composition comprising:

a microemulsion containing a middle distillate base constituent and an additive constituent selected from the group consisting of urea, a urea-based compound, and a triazine compound in an amount sufficient to effect a reduction in $NO_x$ emissions from combustion.

2. A fuel composition according to claim 1, wherein said additive constituent comprises less than about 2% of said composition.

3. A fuel composition according to claim 2, wherein said microemulsion further includes about 5% t-butyl alcohol, about 4.5% water, about 0.5% of said urea or said triazine compound, about 9% oleic acid, and about 1% ethanolamine as added to said middle distillate base constituent.

4. A fuel composition according to claim 1, wherein said middle distillate base constituent is diesel fuel.

5. A fuel composition according to claim 4, wherein said microemulsion further includes about 5% t-butyl alcohol, about 4.5% water, about 9% oleic acid, and about 1% ethanolamine as added to said diesel fuel, and said additive constituent comprises about 0.5% of said urea or said triazine compound.

6. A method for reducing the $NO_x$ emissions resulting from the combustion of fuel, comprising the steps of:

forming a microemulsion by combining an effective amount of an additive constituent selected from the group consisting of urea, a urea-based compound, or a triazine compound and a middle distillate base constituent, thereby creating a fuel; and combusting said fuel in an engine.

7. A method according to claim 6, wherein no more than about 1% of said urea, urea-based compound, and said triazine compound is added to said middle distillate base constituent.

8. A method according to claim 7, wherein said additive constituent further includes an emulsifying agent.

9. A method according to claim 8, wherein about 5% t-butyl alcohol, about 4.5% water, about 0.5% of said urea or said triazine compound, about 9% oleic acid, and about 1% ethanolamine.

10. A method according to claim 6, wherein said middle distillate base constituent is diesel fuel.

11. A method of making a fuel having reduced $NO_x$ emissions, comprising the step of:

forming a microemulsion which includes an additive constituent including urea or a triazine compound and a middle distillate base constituent.

12. A method according to claim 11, wherein no more than about 1% said urea or said triazine compound is added to said middle distillate base constituent.

13. A method according to claim 12, wherein about 5% t-butyl alcohol, about 4.5% water, about 0.5% of said urea or said triazine compound, about 9% oleic acid, and about 1% ethanolamine are added to said middle distillate base constituent.

14. A method according to claim 11, wherein said middle distillate base constituent is diesel fuel.

15. A reduced $NO_x$ emissions fuel composition comprising:

a microemulsion containing a middle distillate base constituent and an additive constituent selected from the group consisting of urea, a urea-based compound, and a triazine compound in an amount sufficient to effect a reduction in $NO_x$ emissions from combustion.

16. The composition according to claim 15, wherein said microemulsion further includes oleic acid.

17. A reduced $NO_x$ emissions fuel composition consisting essentially of:

a microemulsion containing a middle distillate base constituent, a $NO_x$ reducing additive constituent selected from the group consisting of urea, a urea-based compound, and a triazine compound, and t-butyl alcohol, water, oleic acid, and ethanolamine.

18. A reduced $NO_x$ emissions fuel composition consisting essentially of:

a microemulsion containing a middle distillate base constituent, a $NO_x$ reducing additive constituent selected from the group consisting of urea, a urea-based compound, a triazine compound.

19. A fuel composition comprising:

a microemulsion containing middle distillate base constituent; and methylol melamine as an additive in an amount sufficient to effect a reduction in $NO_x$ emissions from combustion.

20. A method for reducing the $NO_x$ emissions resulting from the combustion of fuel, comprising the steps of:

forming a microemulsion by combining an effective amount of a methylol melamine added constituent to a middle distillate base constituent thereby creating a fuel; and combusting said fuel in an engine.

21. A method of making a fuel having reduced $NO_x$ emissions resulting from the combustion of fuel, comprising the step of:

forming a microemulsion which includes an additive constituent including methylol melamine and a middle distillate base constituent.

* * * * *